US006572432B1

(12) United States Patent
Tsai

(10) Patent No.: US 6,572,432 B1
(45) Date of Patent: Jun. 3, 2003

(54) TELESCOPIC MASCOT

(76) Inventor: Chih-Cheng Tsai, No. 13, Chung Hwa Rd., Lin Lo Village, Lin Lo Hsiang, Pingtung Hsien (TW)

( * ) Notice: Subject to any disclaimer, the term of this patent is extended or adjusted under 35 U.S.C. 154(b) by 0 days.

(21) Appl. No.: 10/165,305

(22) Filed: Jun. 10, 2002

(30) Foreign Application Priority Data

Mar. 8, 2002 (TW) ..... 091202726

(51) Int. Cl.[7] ..... A63H 3/36

(52) U.S. Cl. ..... 446/320; 446/314; 446/330; 446/378; 446/489

(58) Field of Search ..... 446/478, 311, 446/312, 314, 315, 320, 330, 331, 365, 366, 378, 489

(56) References Cited

U.S. PATENT DOCUMENTS 202,990 A * 4/1878 Chinnock
773,692 A * 11/1904 Uhrig
2,564,813 A * 8/1951 Moyers, Sr.
2,627,700 A * 2/1953 Weiss
3,710,506 A * 1/1973 Thornell
3,797,166 A * 3/1974 Murray
3,844,061 A * 10/1974 Goldfarb et al.
5,087,219 A * 2/1992 Price ..... 446/336
5,310,380 A * 5/1994 Levy et al. ..... 446/489
6,491,567 B2 * 12/2002 Chan ..... 446/478

* cited by examiner

*Primary Examiner*—Derris H. Banks
*Assistant Examiner*—Ali Abdelwahed
(74) *Attorney, Agent, or Firm*—Venable LLP; Fei-Fei Chao

(57) ABSTRACT

A telescopic mascot includes a head core, a shoulder supporting the head core and a body having a pair of upright telescopic tube assemblies adapted to support the shoulder. Each of the upright telescopic tube assemblies has a plurality of tubes, slidable one in another, to allow the upright telescopic tube assembly to be variable in length between an elongated position and a shortened position, and the tubes are further spring-loaded so as to urge the upright telescopic tube assembly to the elongated position. In addition, a pair of retainers is formed on the lowest tubes and the shoulder is provided with a pair of pivotal hooks adapted to be locked with the retainers when the telescopic tube assemblies is adequately shortened, so as to retain the telescopic tube assemblies in their shortened position.

9 Claims, 9 Drawing Sheets

30
43
63
20
21
73
22
40
41
71
60
61
70
42
31
80
44
82
33
62
81
32
521
52
72
51
53
54
50

TELESCOPIC MASCOT

BACKGROUND OF THE INVENTION

1. Field of the Invention

The present invention relates to a telescopic mascot and, more particularly, to a telescopic mascot which can be shortened for easy storage and transportation.

2. Description of Related Art

Various mascots may be found either in the form of large figures of persons, such as Santa Claus, or in the form of large decorative objects, such as a Christmas tree. Now animated mascots that can sing, wink or swing have been designed to attract more attention to them.

Such mascots are bulky for they have a lot of devices for mechanical and electrical purposes. Particularly, these bulky mascots generally occupy a large space and are not easy to be stored and transported.

Therefore, it is an objective of the invention to provide a telescopic mascot to mitigate and/or obviate the aforementioned problem.

SUMMARY OF THE INVENTION

The object of the present invention is to provide a telescopic mascot which can be shortened for easy storage and transportation.

Other objects, advantages and novel features of the invention will become more apparent from the following detailed description when taken in conjunction with the accompanying drawings.

DETAILED DESCRIPTION OF THE PREFERRED EMBODIMENT

Figure 1:
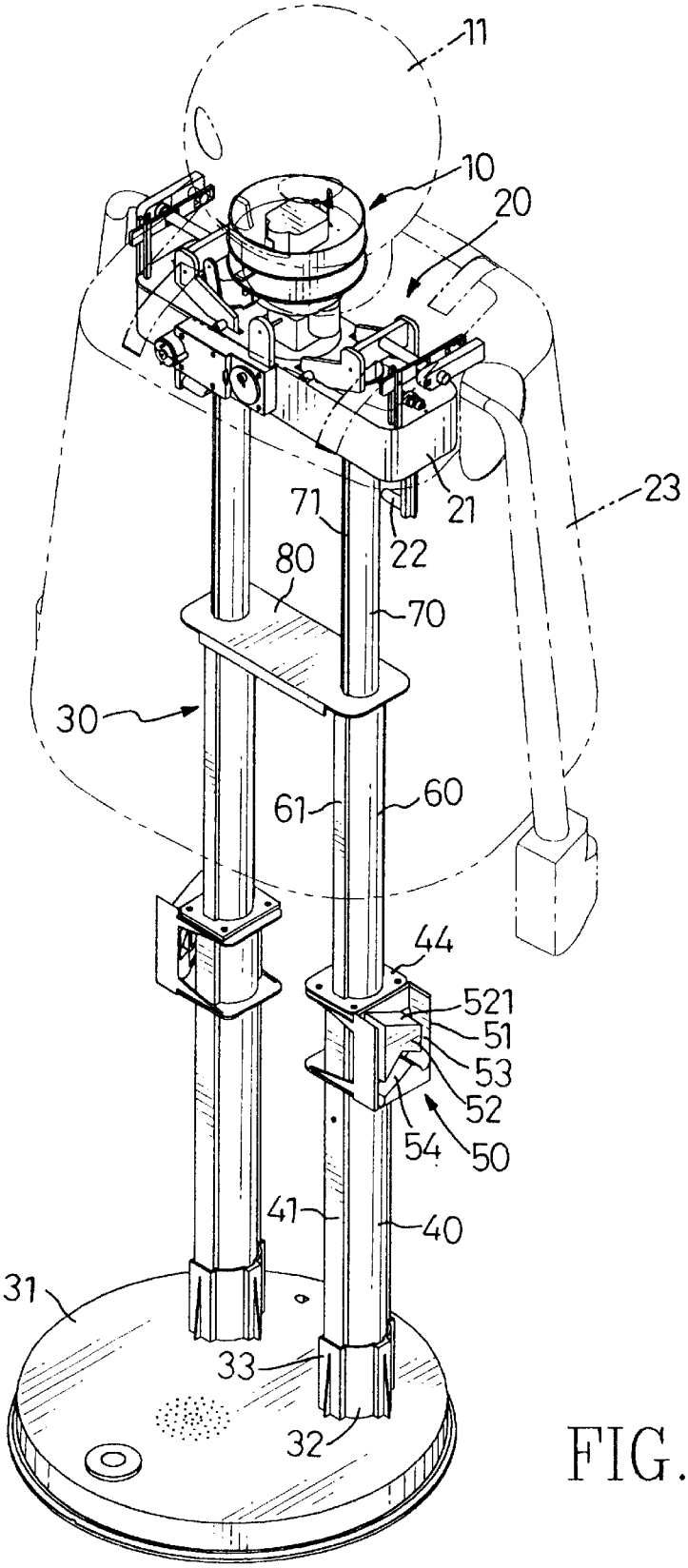
FIG. 1 is a perspective view of a preferred embodiment of a telescopic mascot in accordance with the present invention.

Referring to FIG. 1, there is shown a preferred embodiment of a telescopic mascot in accordance with the present invention configured into a large figure of a person. The mascot includes a head core (10) covered with a head shell (11) and supported on a shoulder (20). The shoulder (20) is to be covered with a cloak (23) of a flexible material, such as of cloth or plastic sheet, hanging from an outer frame (21) of the shoulder (20).

The shoulder (20) is in turn supported by a body (30) that is partially behind the cloak (23). In detail, the body (30) includes a base (31) having two mounting sleeves (32) for the purpose of holding a pair of upright telescopic tube assemblies (not numbered) that are adapted to support the shoulder (20). In the illustrated embodiment, each of the tube assemblies has three telescopic tubes, including a lowest outer tube (40), an intermediate inner tube (60) and a top inner tube (70), slidable one in another.

It is apparent that the arrangement of such tubes (40, 60, 70) allows the upright telescopic tube assemblies to be variable in their length between an elongated position, in which the mascot becomes taller, and a shortened position, in which the mascot becomes shorter.

Figure 2:
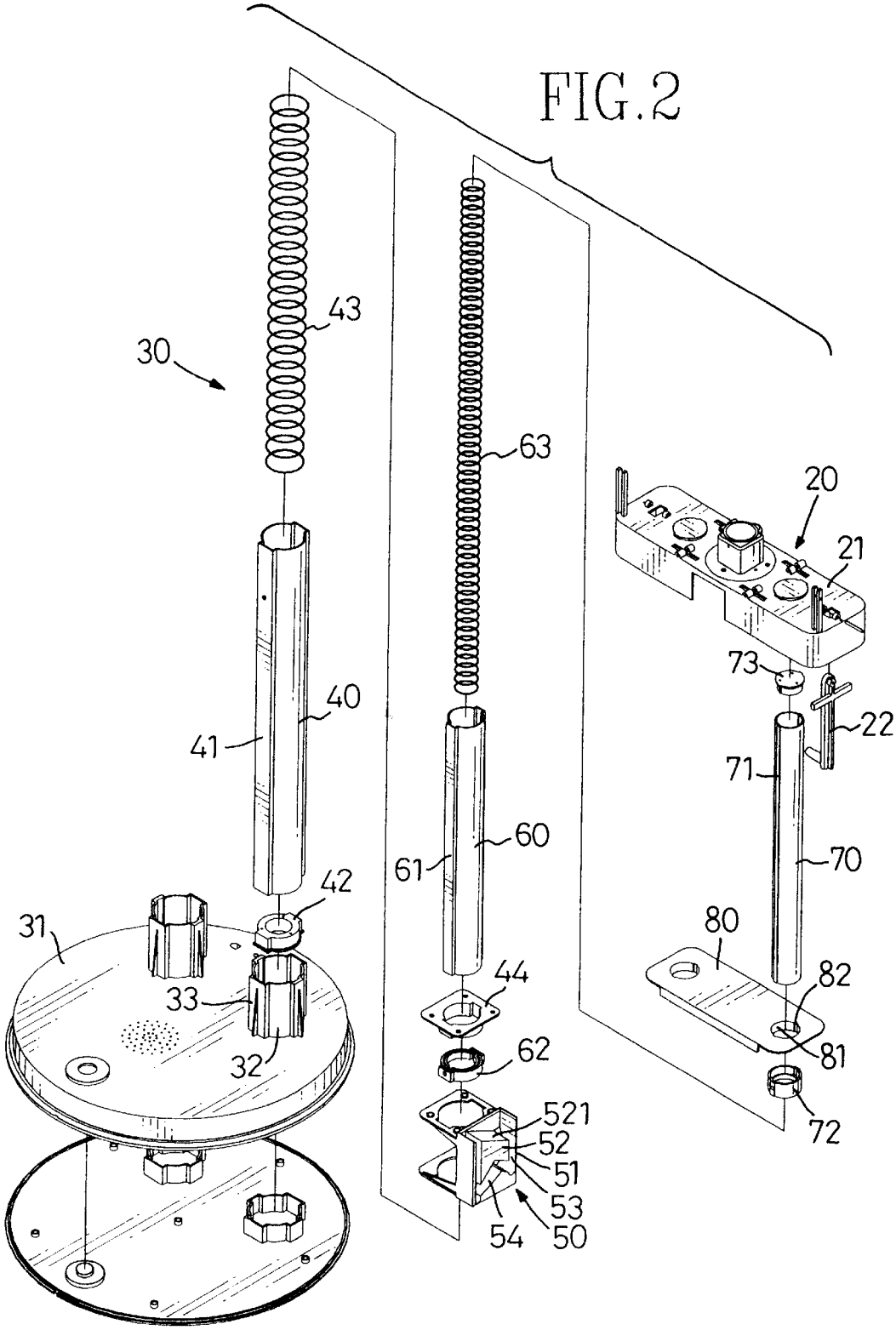
FIG. 2 is an exploded perspective view of the telescopic mascot shown in FIG. 1.
Figure 3:
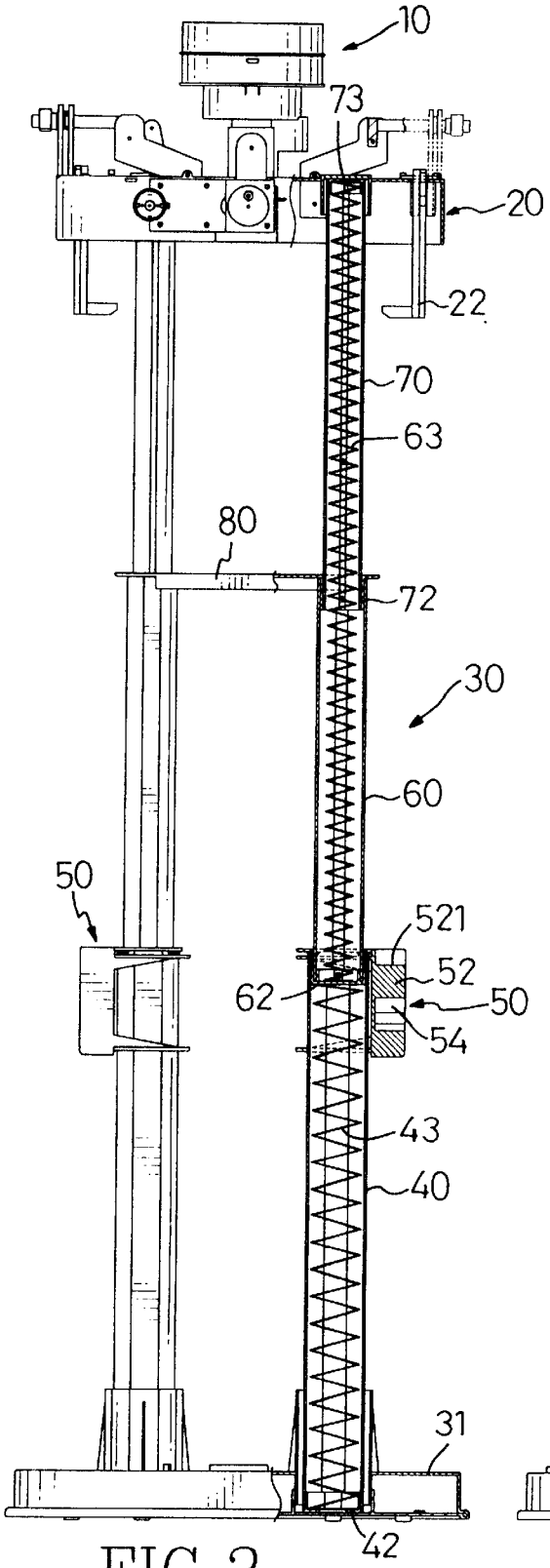
FIG. 3 is a fragmentary cross-sectional front view of the telescopic mascot shown in FIG. 1.

Referring to FIGS. 2 and 3, the mounting sleeves (32) and the tubes (40, 60, 70) are preferably formed with respective longitudinal concavo-convex ribs (33, 41, 61, 71), mating one with another, which allows any of the inner tubes (60, 70) to be slidable but not rotatable with respect to the others.

In addition, each lowest outer tube (40) has a lower end formed with an end closure (42) and an upper end formed with a stopper (44), while each intermediate inner tube (60) has a lower end formed with a first collar (62) that is disposed within the outer tube (40) just under the stopper (44). This first collar (62) is engagable with the stopper (44) when the intermediate inner tube (60) is fully extended from the lowest outer tube (40), thus preventing the intermediate inner tube (60) from separating from the lowest outer tube (40).

Received in the lowest outer tube (40) is a first helical spring (43) that is compressed between the end closure (42) of the lowest outer tube (40) and the first collar (62) of the intermediate inner tube (60), as clearly shown in FIG. 3, and so the intermediate inner tube (60) is urged to be fully extended from the lowest outer tube (40).

The two intermediate inner tubes (60) have respective upper ends connected together, as best shown in FIGS. 1 and 2, by a transverse bridge (80) that has a pair of skirts (81) extending into the intermediate inner tubes (60), with concave-convex ribs (82) of the skirts (81) fitted in those (61) of the tubes (60). Similar to the intermediate inner tubes (60), each top inner tube (70) has a lower end formed with a second collar (72) disposed within the intermediate inner tube (60) but under the corresponding one of the skirts (81) of the bridge (80). The second collars (72) are engagable with the skirts (81) when the top inner tubes (70) are fully extended from the intermediate inner tubes (60), and so prevent the top inner tubes (70) from separating from the intermediate inner tubes (60).

In each tube assembly, the top inner tube (70) further has an upper end formed with a cover (73), and a second helical spring (63) is received in the inner tubes (60, 70) and compressed between the cover (73) of the top tube (70) and the first collar (62) of the intermediate tube (60) to urge the top inner tube (70) to be fully extended out of the intermediate inner tube (60).

It is by these springs (43, 63) that the inner tubes (60, 70) tend to be moved out of the subsequent tubes (40, 60). In other words, the tubes (40, 60, 70) are spring-loaded so as to urge the upright telescopic tube assemblies to the elongated position, as shown in FIG. 3.

Figure 4:
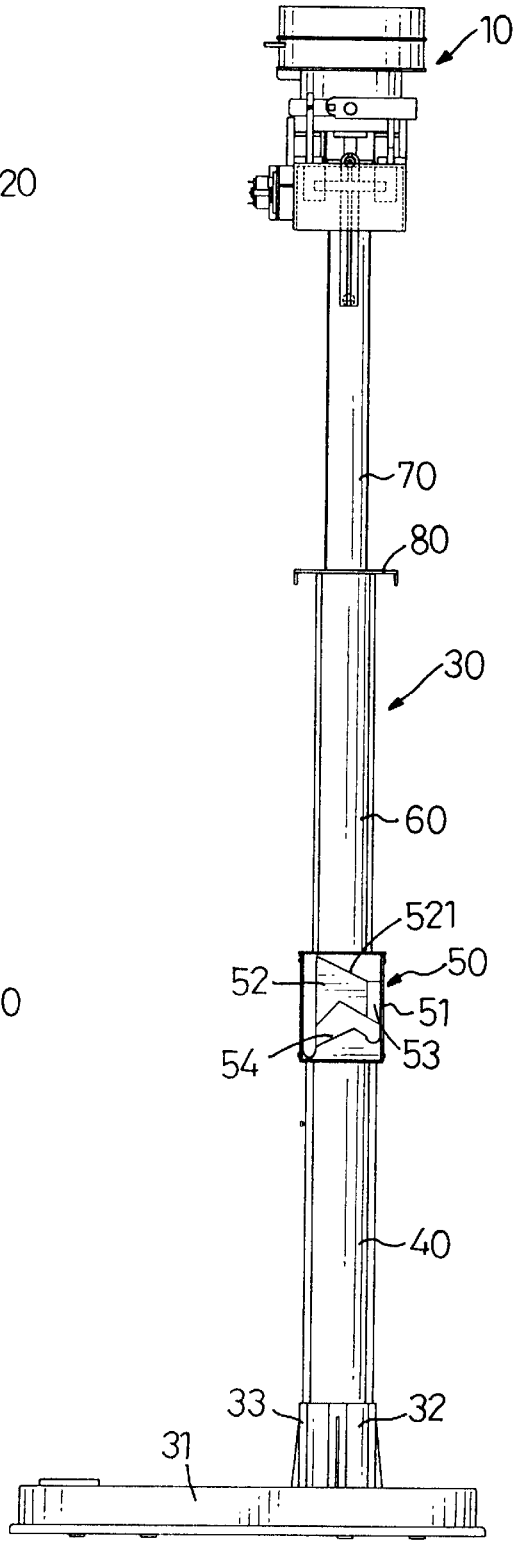
FIG. 4 is a side view of the telescopic mascot shown in FIG. 1.

Referring to FIGS. 3, and 4, each tube assembly further includes a retainer (50) formed on its lowest outer tube (40). In a highly preferred embodiment, each of the retainers (50) has two parallel wings (51) formed at opposed sides of a protuberance (52), with a pair of spanned upright channels (53) defined between the wings (51) and the protuberance (52). Furthermore, the protuberance (52) has an inclined top (521) slopping towards one of the channels (53) and defines an upwardly-curved slot (54) in communication with the two channels (53).

In the inventive mascot, the shoulder (20) is provided with a pair of hooks (22) that are adapted to be locked with the retainer (50), so as to retain the telescopic tube assemblies in their shortened position.

Referring to FIGS. 5 through 9, the inventive mascot can be telescoped simply by pressing it down, such as at its shoulder (20), until the tube assemblies are adequately shortened.

Figure 6:
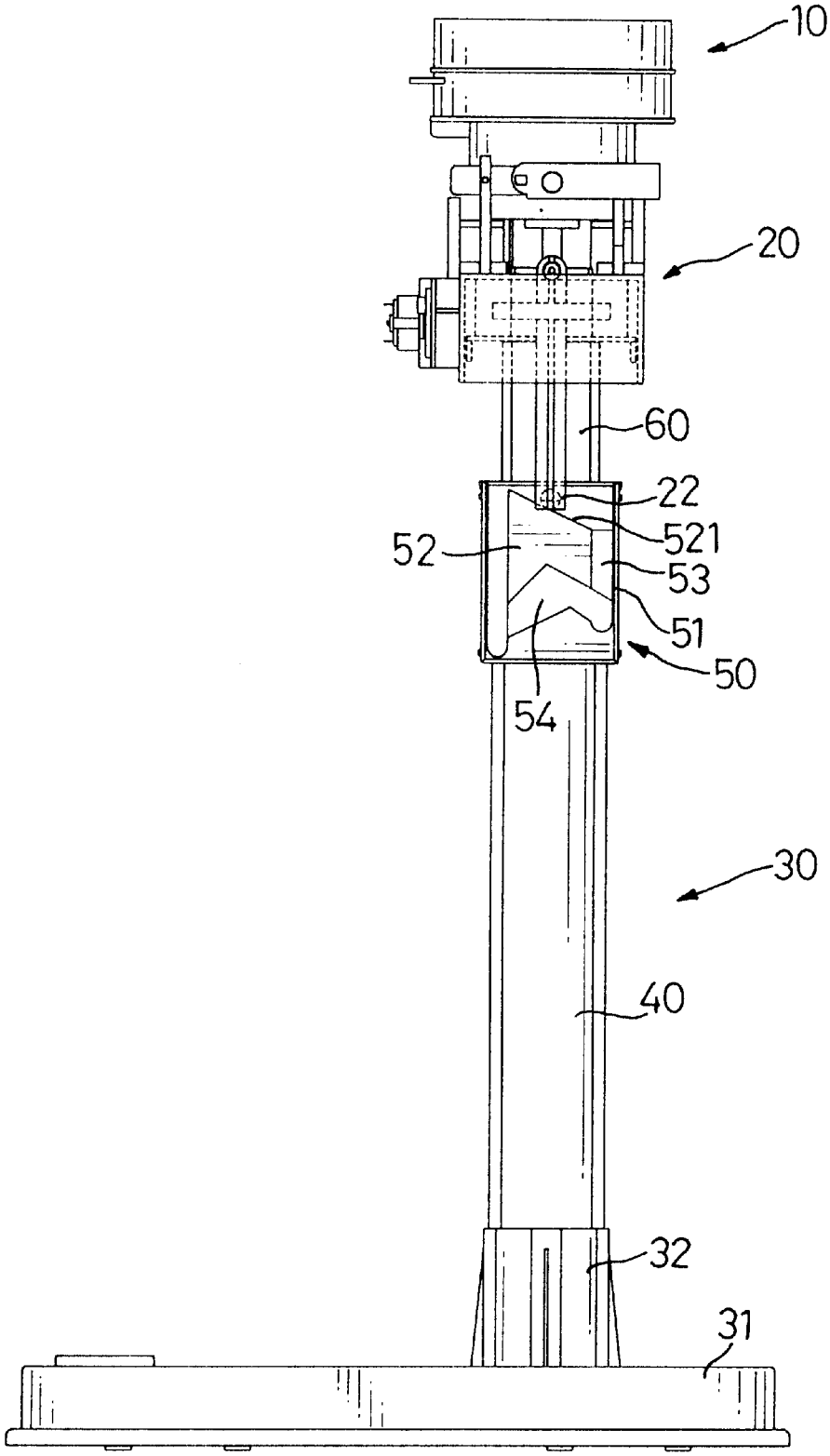
FIG. 6 is a side view of the telescopic mascot, showing a hook brought into contact with a retainer on an inclined top of a protuberance.
Figure 7:
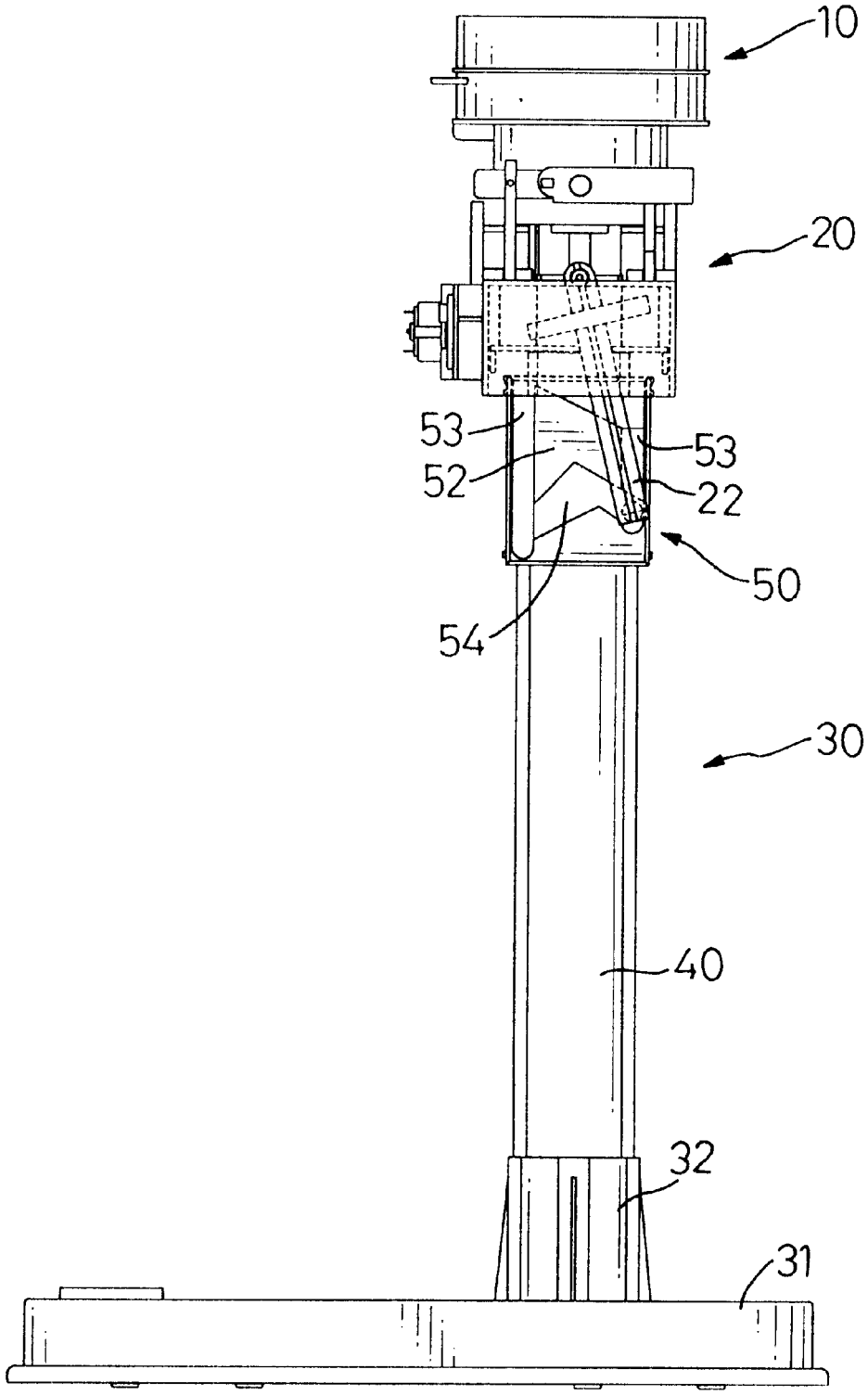
FIG. 7 is a side view of the telescopic mascot, showing the hook slid into an upright channel of the retainer.

With the continuous lowering of the shoulder (20), as shown in FIG. 6, each pivotal hook (22) is brought into contact with the corresponding one of the retainers (50) on the inclined top (521) of the protuberance (52), and then slides over this inclined top (521) into the upright channel (53) on the right-hand side, as viewed in FIG. 7.

Figure 8:
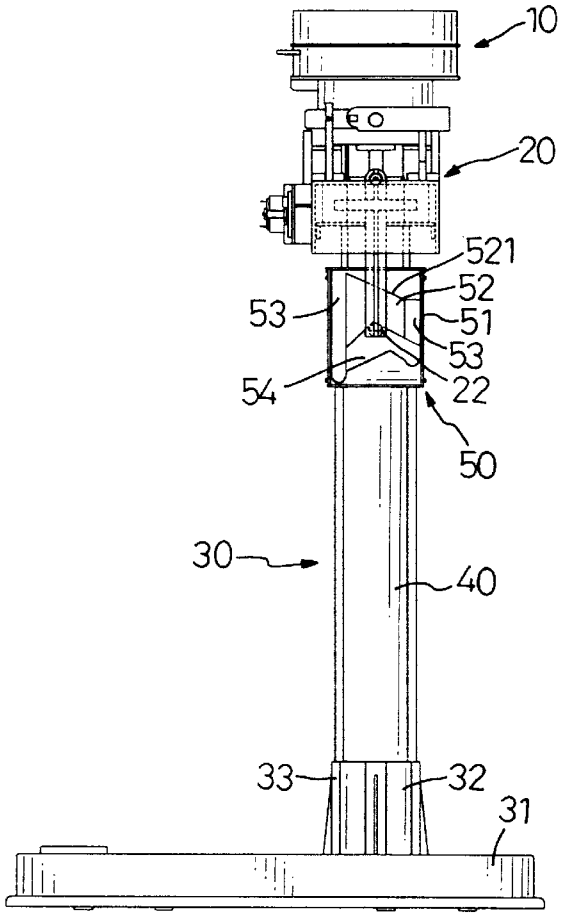
FIG. 8 is a side view of the telescopic mascot, showing the hook slid into an upwardly-curved slot of the retainer from the upright channel.
Figure 9:
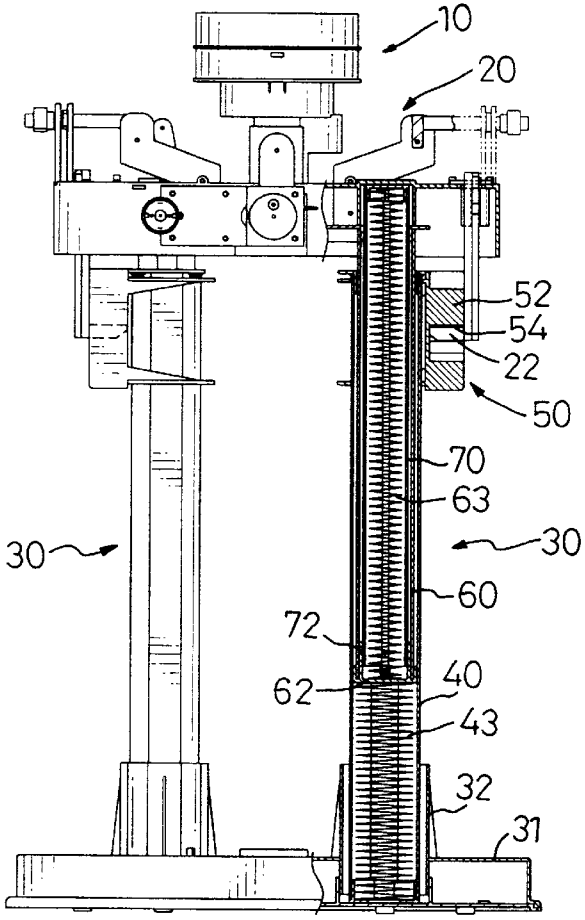
FIG. 9 is a fragmental cross-sectional front view of the telescopic mascot of FIG. 1 in the shortened configuration.

At this time, the hook (22) will be moved from the channel (53) into the upwardly-curved slot (54) by the action of the compressed springs (43, 63) once the shoulder (20) is released, as can be seen in FIGS. 8 and 9, thereby being locked with the retainer (50) and hence retaining the telescopic tube assemblies in their shortened position. This makes the inventive mascot become shorter.

Figure 5:
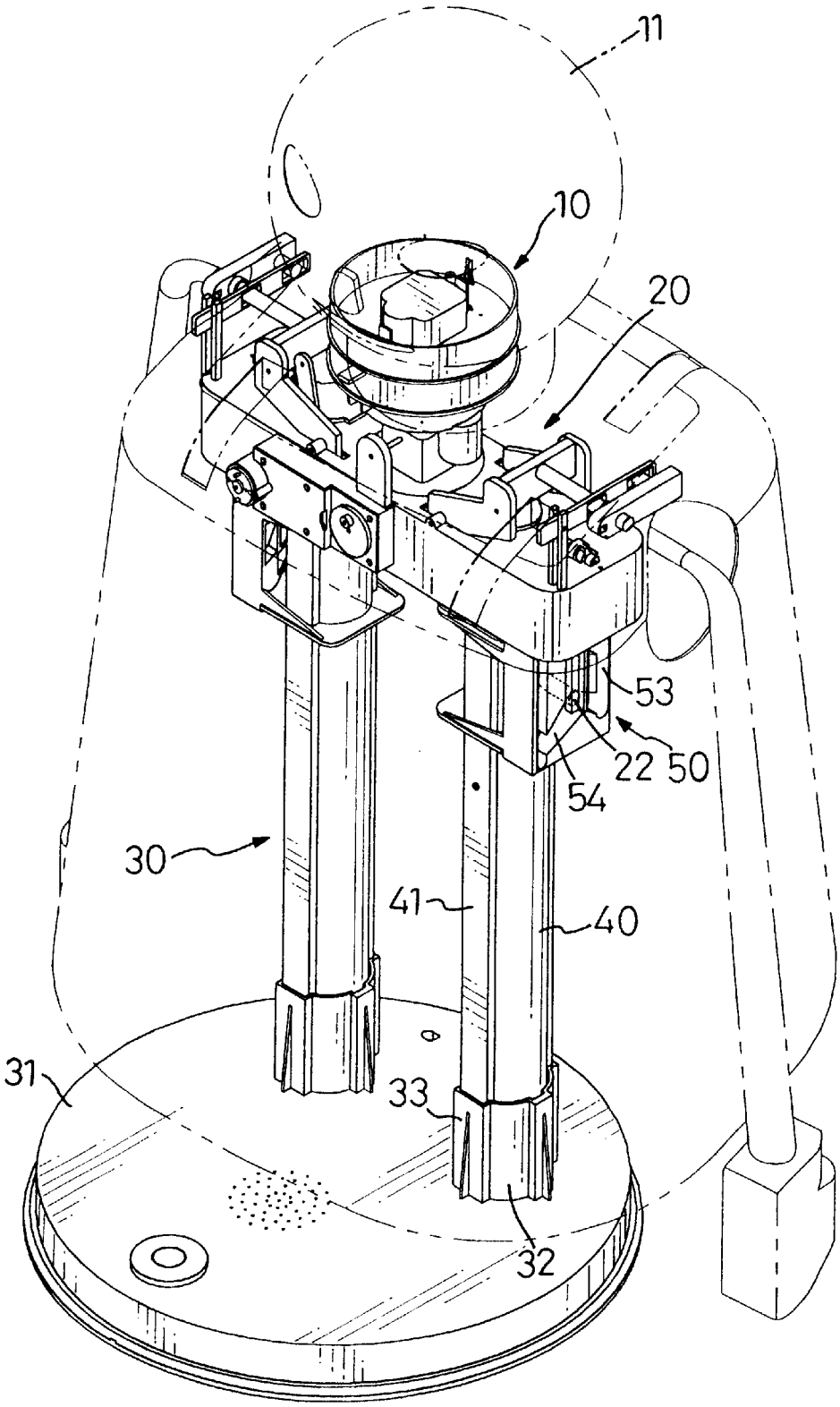
FIG. 5 is a perspective view showing the telescopic mascot of FIG. 1 in a shortened configuration.
Figure 10:
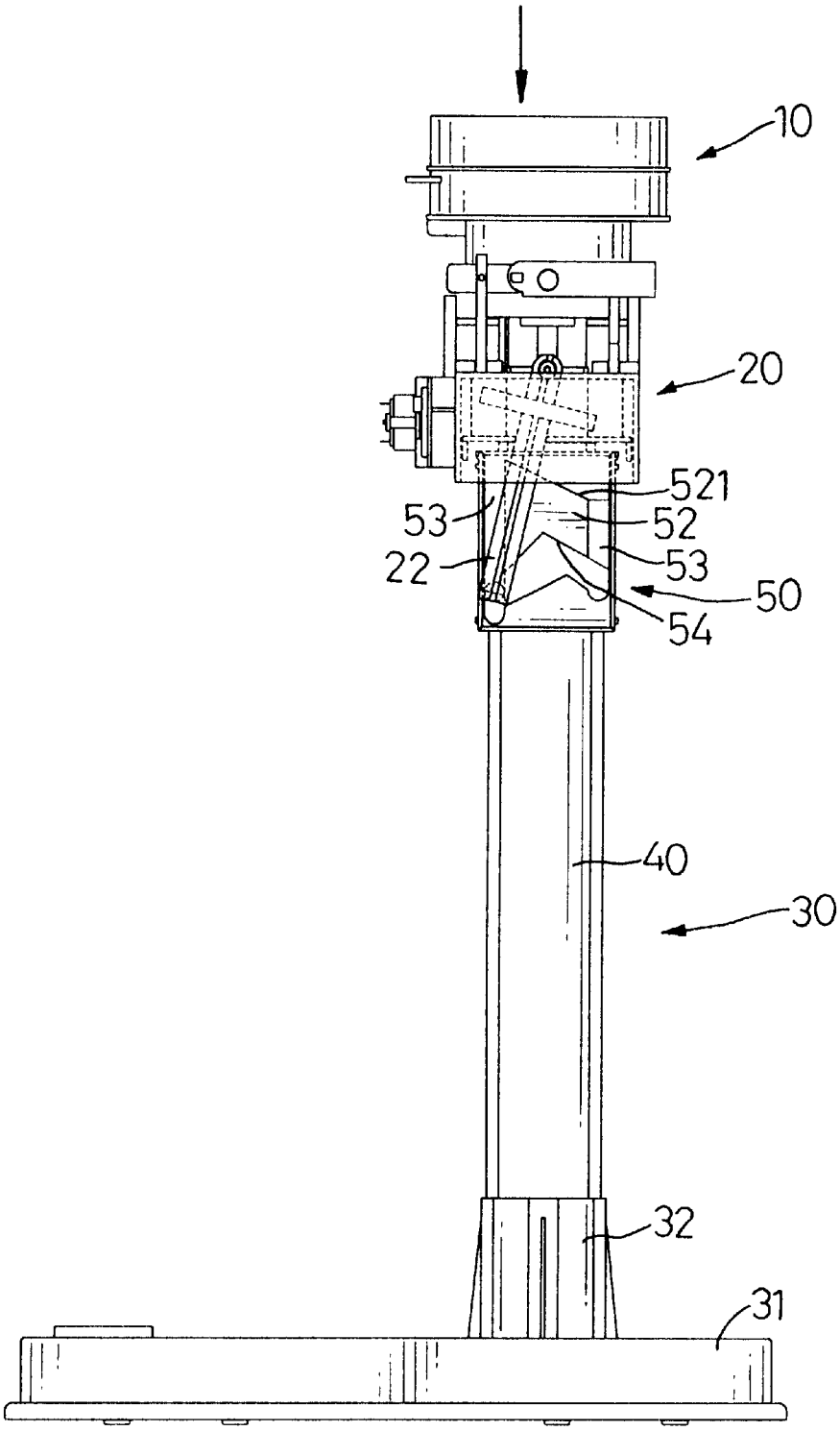
FIG. 10 is a side view of the telescopic mascot, showing the hook moved into another upright channel from the upwardly-curved slot of the retainer.
Figure 11:
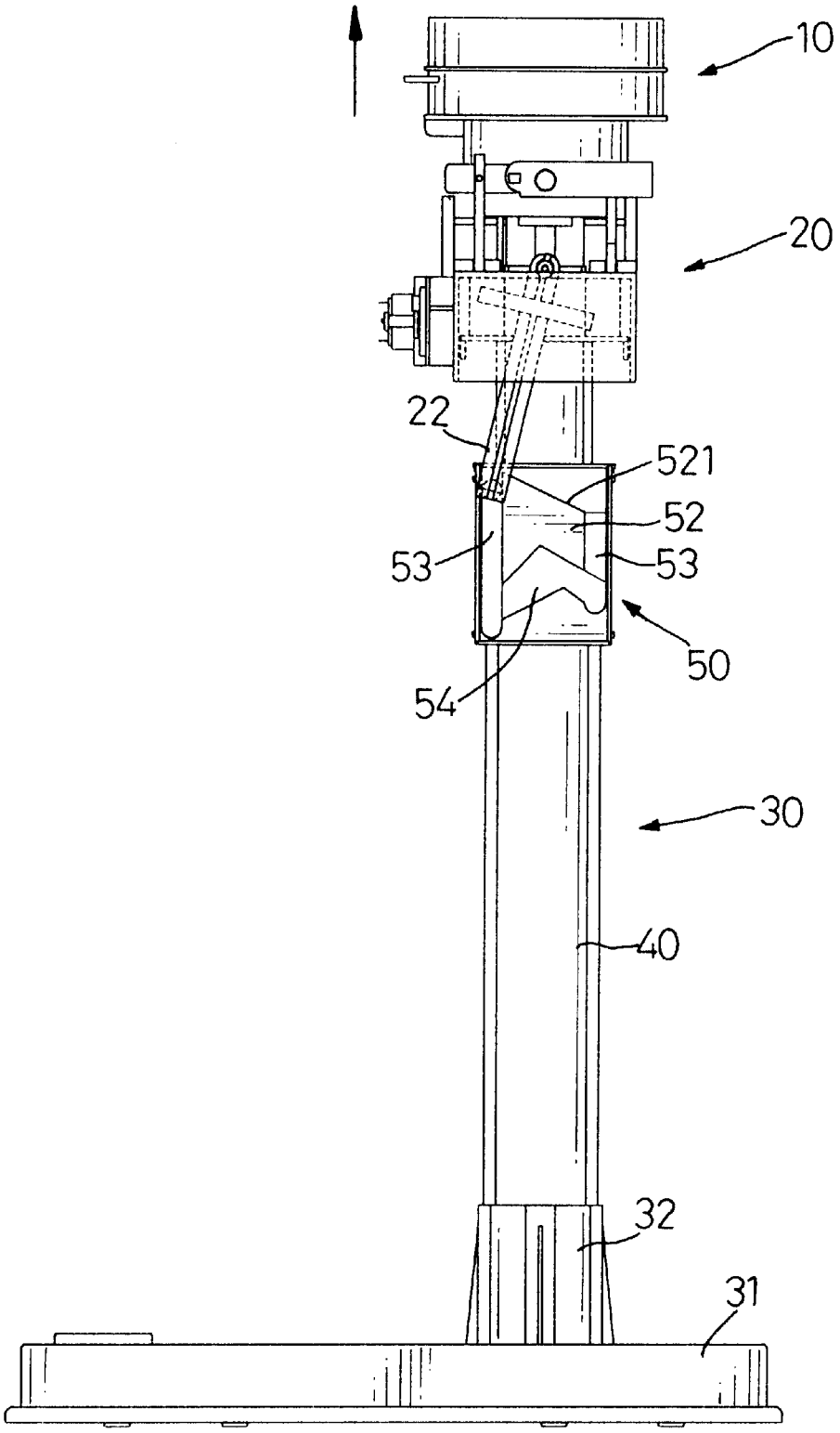
FIG. 11 is a side view of the telescopic mascot, showing the hook move upward along the latter upright channel.

Referring to FIGS. 10 and 11, the taller configuration of the inventive mascot can be recovered by pressing the shoulder (20) down again until each pivotal hook (22) is moved from the upwardly-curved slot (54) into the upright channel (53) on the left-hand side, as viewed in FIG. 5. The spring-loaded telescopic tube assemblies will then return to their elongated position as soon as the shoulder (20) is released, which, indeed, makes the mascot become taller again.

From the above description, it is noted that the invention has the advantage of being able to be shortened for easy storage and transportation.

It is to be understood, however, that even though numerous characteristics and advantages of the present invention have been set forth in the foregoing description, together with details of the structure and function of the invention, the disclosure is illustrative only and changes may be made in detail. For example, a single telescopic tube assembly may be used for a mascot that is configured as a decorative Christmas tree. The present invention is intended to cover all variants and modifications falling into the scope of the invention indicated by the broad general meaning of the terms in which the appended claims are expressed.

What is claimed is:

1. A telescopic mascot comprising a head core (10), a shoulder (20) supporting said head core (10), and a body (30) having at least one upright telescopic tube assembly adapted to support said shoulder (20), said at least one upright telescopic tube assembly comprising:

a plurality of tubes (40, 60, 70) slidable with respect to each other to allow said upright telescopic tube assembly to be variable in length between an elongated position and a shortened position;

said tubes (40, 60, 70) being spring-loaded so as to press said upright telescopic tube assembly to said elongated position; and a retainer (50) formed on a lowest one of said tubes (40, 60, 70);

wherein said shoulder (20) is provided with a pivotal hook (22) adapted to be locked with said retainer (50) when said telescopic tube assembly is adequately shortened, thereby retaining said telescopic tube assembly in said shortened position; and said retainer (50) defines a pair of spanned upright channels (53) and an upwardly-curved slot (54) in communication with said spanned upright channels (53), and said pivotal hook (22) is movable into said upwardly-curved slot (54) via one of said upright channels (53), thereby being locked with said retainer (50) and hence retaining said telescopic tube assembly in said shortened position.

2. The telescopic mascot as claimed in claim 1, wherein said tubes (40, 60, 70) are formed with respective longitudinal concave-convex ribs (41, 61, 71) mating one with another, thereby allowing any of said tubes (40, 60, 70) to be slidable but not rotatable with respect to other tubes.

3. The telescopic mascot as claimed in claim 1, wherein said upright telescopic tube assembly includes a lowest outer tube (40), an intermediate inner tube (60) and a top inner tube (70) slidable one in another.

4. The telescopic mascot as claimed in claim 3, wherein said lowest outer tube (40) has an upper end formed with a stopper (44), and wherein said intermediate inner tube (60) has a lower end formed with a first collar (62) disposed under said stopper (44) and said first collar (62) is engagable with said stopper (44) when said intermediate inner tube (60) is fully extended out of said lowest outer tube (40), thereby preventing said intermediate inner tube (60) from separating from said lowest outer tube (40).

5. The telescopic mascot as claimed in claim 4, wherein said lowest outer tube (40) has a lower end formed with an end closure (42), and wherein a first helical spring (43) is received in said lowest outer tube (40) and compressed between said end closure (42) of said lowest outer tube (40) and said first collar (62) of said intermediate inner tube (60), thereby urging said intermediate inner tube (60) to be fully extended out of said lowest outer tube (40).

6. The telescopic mascot as claimed in claim 5, wherein said body (30) has a pair of upright telescopic tube assemblies adapted to support said shoulder (20), wherein the pair of upright telescopic tube assemblies have two lowest outer tubes (40), two intermediate inner tubes (60), and two top inner tubes (70).

7. The telescopic mascot as claimed in claim 6, wherein said body (30) further has a bridge (80) connecting upper ends of said intermediate inner tubes (60), and wherein said bridge (80) has a pair of skirts (81) extending into said intermediate inner tubes (60).

8. The telescopic mascot as claimed in claim 7, wherein said top inner tubes (70) each have a lower end formed with a second collar (72) disposed under a corresponding one of said skirts (81) of said bridge (80), and wherein said second collars (72) of said top inner tubes (70) are engagable with said skirts (81) when said top inner tubes (70) are fully extended from said intermediate inner tubes (60), thereby preventing said top inner tubes (70) from separating from said intermediate inner tubes (60).

9. The telescopic mascot as claimed in claim 8, wherein each of said top inner tubes (70) has an upper end formed with a cover (73), and wherein each of said upright telescopic tube assemblies includes a second helical spring (63) received in said intermediate and top inner tubes (60, 70) and is compressed between said cover (73) of said top inner tube (70) and said first collar (62) of said intermediate inner tube (60), thereby pressing said top inner tube (70) to be fully extended out of said intermediate inner tube (60).

* * * * *